US010343021B1

(12) United States Patent
Ogg et al.

(10) Patent No.: US 10,343,021 B1
(45) **Date of Patent: *Jul. 9, 2019**

(54) GOLF BALL HAVING CORE COMPOSED OF A HIGHLY NEUTRALIZED POLYMER

(71) Applicant: Callaway Golf Company, Carlsbad, CA (US)

(72) Inventors: Steve Ogg, Carlsbad, CA (US); David Bartels, Carlsbad, CA (US)

(73) Assignee: Callaway Golf Company, Carlsbad ( * ) Notice: Subject to any disclaimer, the term of this patent is extended or adjusted under 35 U.S.C. 154(b) by 0 days.

This patent is subject to a terminal disclaimer.

(21) Appl. No.: 16/030,409

(22) Filed: Jul. 9, 2018

Related U.S. Application Data

(63) Continuation of application No. 15/368,329, filed on Dec. 2, 2016, now Pat. No. 10,016,657, which is a continuation of application No. 14/643,043, filed on Mar. 10, 2015, now Pat. No. 9,511,265, which is a continuation of application No. 13/798,808, filed on Mar. 13, 2013, now Pat. No. 8,974,318.

(60) Provisional application No. 61/723,574, filed on Nov. 7, 2012.

(51) Int. Cl.

| | |
|---|---|
| ***A63B 37/06*** | (2006.01) |
| ***A63B 37/12*** | (2006.01) |
| ***A63B 37/04*** | (2006.01) |
| ***A63B 37/00*** | (2006.01) |

(52) U.S. Cl.
CPC ..... *A63B 37/0076* (2013.01); *A63B 37/008* (2013.01); *A63B 37/0031* (2013.01); *A63B 37/0033* (2013.01); *A63B 37/0039* (2013.01); *A63B 37/0043* (2013.01); *A63B 37/0045* (2013.01); *A63B 37/0047* (2013.01); *A63B 37/0062* (2013.01); *A63B 37/0064* (2013.01); *A63B 37/0066* (2013.01); *A63B 37/0067* (2013.01); *A63B 37/0075* (2013.01); *A63B 37/0078* (2013.01); *A63B 37/0082* (2013.01); *A63B 37/0083* (2013.01); *A63B 37/0091* (2013.01); *A63B 37/0092* (2013.01); *A63B 37/0035* (2013.01)

(58) Field of Classification Search
USPC ..... 473/351–385
See application file for complete search history.

(56) References Cited

U.S. PATENT DOCUMENTS

| | | | | |
|---|---|---|---|---|
| 4,792,141 | A * | 12/1988 | Llort | A63B 37/0003 473/378 |
| 6,068,561 | A * | 5/2000 | Renard | A63B 37/12 473/354 |
| 6,379,269 | B1 * | 4/2002 | Nesbitt | A63B 37/0003 473/351 |
| 6,613,842 | B2 * | 9/2003 | Rajagopalan | A63B 37/0003 473/354 |
| 6,688,991 | B2 * | 2/2004 | Sullivan | A63B 37/0003 473/351 |
| 6,756,436 | B2 * | 6/2004 | Rajagopalan | A63B 37/0004 473/372 |
| 6,776,731 | B2 * | 8/2004 | Shannon | A63B 37/0004 473/378 |

(Continued)

*Primary Examiner* — Alvin A Hunter
(74) *Attorney, Agent, or Firm* — Michael A. Catania; Sonia Lari; Rebecca Hanovice

(57) ABSTRACT

A golf ball comprising a core composed of a fully neutralized polymer material is disclosed herein. The golf ball also preferably has multiple mantle layers and a cover.

4 Claims, 4 Drawing Sheets

(56) References Cited

U.S. PATENT DOCUMENTS 6,852,784 B2 * 2/2005 Sullivan ..... A63B 37/0003 473/371
6,988,962 B2 * 1/2006 Sullivan ..... A63B 37/0003 473/376
7,001,287 B2 * 2/2006 Ladd ..... A63B 37/0003 473/376
7,004,854 B2 * 2/2006 Hogge ..... A63B 37/0003 473/374
7,041,009 B2 * 5/2006 Sullivan ..... A63B 37/0003 473/376
7,041,721 B2 * 5/2006 Rajagopalan ..... A63B 37/0003 473/372
7,207,903 B2 * 4/2007 Sullivan ..... A63B 37/0003 473/376
7,230,045 B2 * 6/2007 Rajagopalan ..... A63B 37/0004 473/372
7,300,364 B2 * 11/2007 Boehm ..... A63B 37/0003 473/376
7,331,878 B2 * 2/2008 Boehm ..... A63B 37/0003 473/376
7,354,357 B2 * 4/2008 Sullivan ..... A63B 37/0003 473/373
7,361,102 B2 * 4/2008 Ladd ..... A63B 37/0003 473/376
7,468,006 B2 * 12/2008 Sullivan ..... A63B 37/0003 473/376
7,517,289 B2 * 4/2009 Sullivan ..... A63B 37/0003 473/376
7,582,026 B2 * 9/2009 Kamino ..... A63B 37/0031 473/376
7,722,482 B2 * 5/2010 Sullivan ..... A63B 37/0043 473/376
7,815,526 B2 * 10/2010 Sullivan ..... A63B 37/0003 473/376
7,999,019 B2 * 8/2011 Nakamura ..... C08G 18/7664 473/378
8,096,899 B2 * 1/2012 Kim ..... A63B 37/0003 473/374
8,168,710 B2 * 5/2012 Rajagopalan ..... A63B 37/0043 473/373
8,211,976 B2 * 7/2012 Kim ..... A63B 37/0003 473/371
8,357,060 B2 * 1/2013 Loper ..... A63B 37/0003 473/376
8,475,298 B2 * 7/2013 Ogg ..... A63B 37/0003 473/376
8,784,236 B2 * 7/2014 Sullivan ..... A63B 37/0043 473/373
8,858,365 B2 * 10/2014 Loper ..... A63B 37/0076 473/373
8,932,154 B2 * 1/2015 Snell ..... A63B 37/0003 473/376
8,956,250 B1 * 2/2015 Parnell ..... A63B 37/0031 473/376
8,974,318 B1 * 3/2015 Ogg ..... A63B 37/0076 473/376
8,979,677 B2 * 3/2015 Loper ..... A63B 37/0003 473/371
8,992,342 B2 * 3/2015 Sullivan ..... A63B 37/0031 473/376
9,005,052 B1 * 4/2015 Parnell ..... A63B 37/0051 473/376
9,050,502 B1 * 6/2015 Bartels ..... A63B 37/0076
2007/0167256 A1 * 7/2007 Binette ..... A63B 37/0003 473/367

* cited by examiner

GOLF BALL HAVING CORE COMPOSED OF A HIGHLY NEUTRALIZED POLYMER

CROSS REFERENCES TO RELATED APPLICATIONS

The present application is a continuation application of U.S. patent application Ser. No. 15/368,329, filed on Dec. 2, 2016, which is a continuation application of U.S. patent application Ser. No. 14/643,043, filed on Mar. 10, 2015, now U.S. Pat. No. 9,511,265, issued on Dec. 6, 2016, which is a continuation application of U.S. patent application Ser. No. 13/798,808, filed on Mar. 13, 2013, now U.S. Pat. No. 8,974,318, issued on Mar. 10, 2015, which claims priority to U.S. Provisional Patent Application No. 61/723,574, filed on Nov. 7, 2012, all of which are hereby incorporated by reference in their entireties.

STATEMENT REGARDING FEDERALLY SPONSORED RESEARCH OR DEVELOPMENT

Not Applicable

BACKGROUND OF THE INVENTION

Field of the Invention

The present invention relates to golf balls. Particularly to golf balls having a core composed of a highly neutralized polymer, a quadruple mantle and a thermoplastic polyurethane cover.

Description of the Related Art

Sullivan et al., U.S. Pat. No. 4,911,451, for a Golf Ball Cover Of Neutralized Polyethylene-acrylic acid) Copolymer, discloses in Table One a golf ball having a compression of below 50 and a cover composed of ionomers having various Shore D hardness values ranging from 50 to 61.

Sullivan, U.S. Pat. No. 4,986,545, for a Golf Ball discloses a golf ball having a Rhiele compression below 50 and a cover having Shore C values as low as 82.

Egashira et al., U.S. Pat. No. 5,252,652, for a Solid Golf Ball, discloses the use of a zinc pentachlorothiophenol in a core of a golf ball.

Pasqua, U.S. Pat. No. 5,721,304, for a Golf Ball Composition, discloses a golf ball with a core having a low compression and the core comprising calcium oxide.

Sullivan, et al., U.S. Pat. No. 5,588,924, for a Golf Ball discloses a golf ball having a PGA compression below 70 and a COR ranging from 0.780 to 0.825.

Sullivan et al., U.S. Pat. No. 6,142,886, for a Golf Ball And Method Of Manufacture discloses a golf ball having a PGA compression below 70, a cover Shore D hardness of 57, and a COR as high as 0.794.

Tzivanis et al., U.S. Pat. No. 6,520,870, for a Golf Ball, discloses a golf ball having a core compression less than 50, a cover Shore D hardness of 55 or less, and a COR greater than 0.80.

The prior art fails to disclose a five layer golf ball with a dual core that produces a high spin for short game shots and low spin for driver shots.

BRIEF SUMMARY OF THE INVENTION

The present invention provides a golf ball with six layers such that the golf ball produces greater distance.

Preferably, the golf ball cover is composed of a thermoplastic polyurethane/polyurea material. The golf ball cover preferably has a thickness ranging from 0.015 inch to 0.045 inch. Each mantle layer is preferably composed of an ionomer material such as SURLYN or HPF. The golf ball core is preferably composed of a highly neutralized polymer material.

Preferably, each mantle layer is composed of an ionomer material. Alternatively, each mantle layer is composed of a blend of ionomer materials. Alternatively, at least one of the mantle layer is composed of a highly neutralized ionomer material. Preferably, each mantle layer has a thickness ranging from 0.030 inch to 0.050 inch.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention is directed to a golf ball comprising a core composed of a highly neutralized polymer material, a four layers mantle component and a cover layer.

Figure 1:
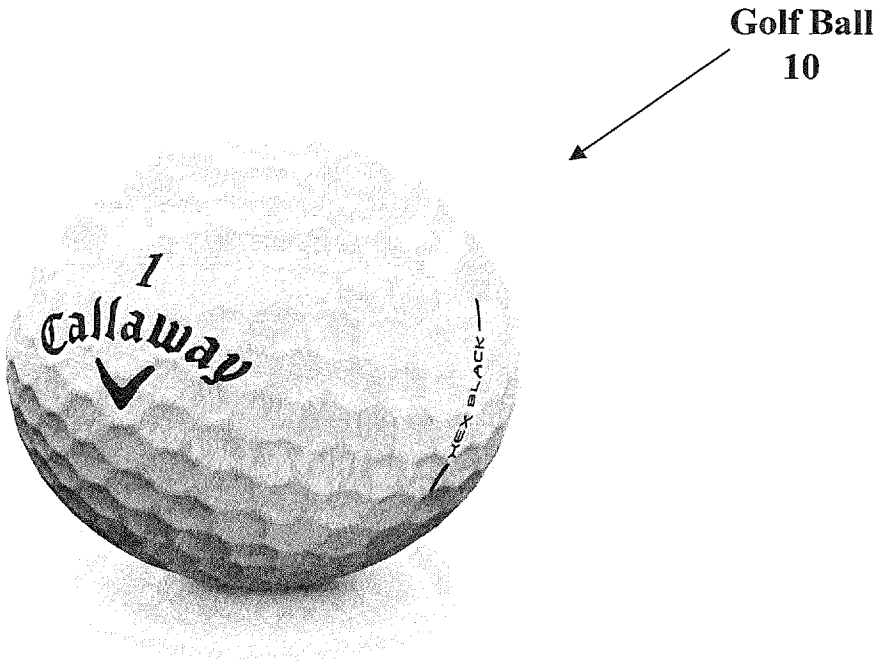
FIG. 1 is top perspective view of a golf ball.
Figure 2:
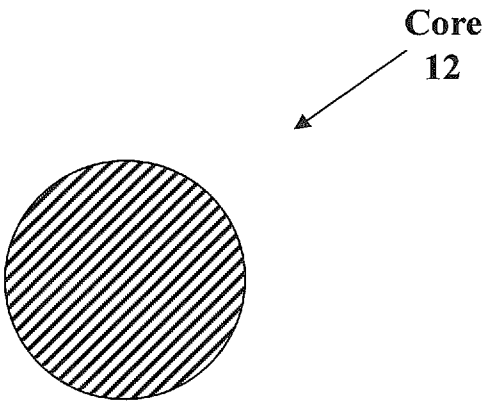
FIG. 2 is a cross-sectional view of a core component of a golf ball.
Figure 3:
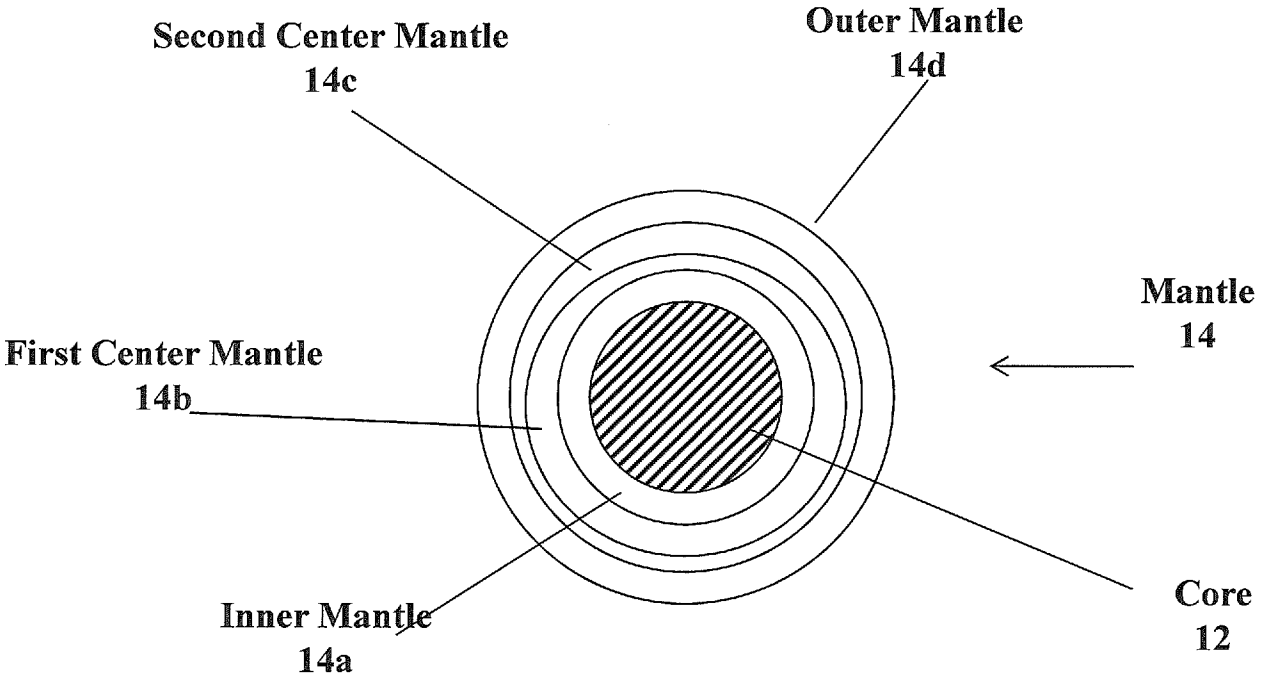
FIG. 3 is a cross-sectional view of a core component and a mantle component of a golf ball.
Figure 4:
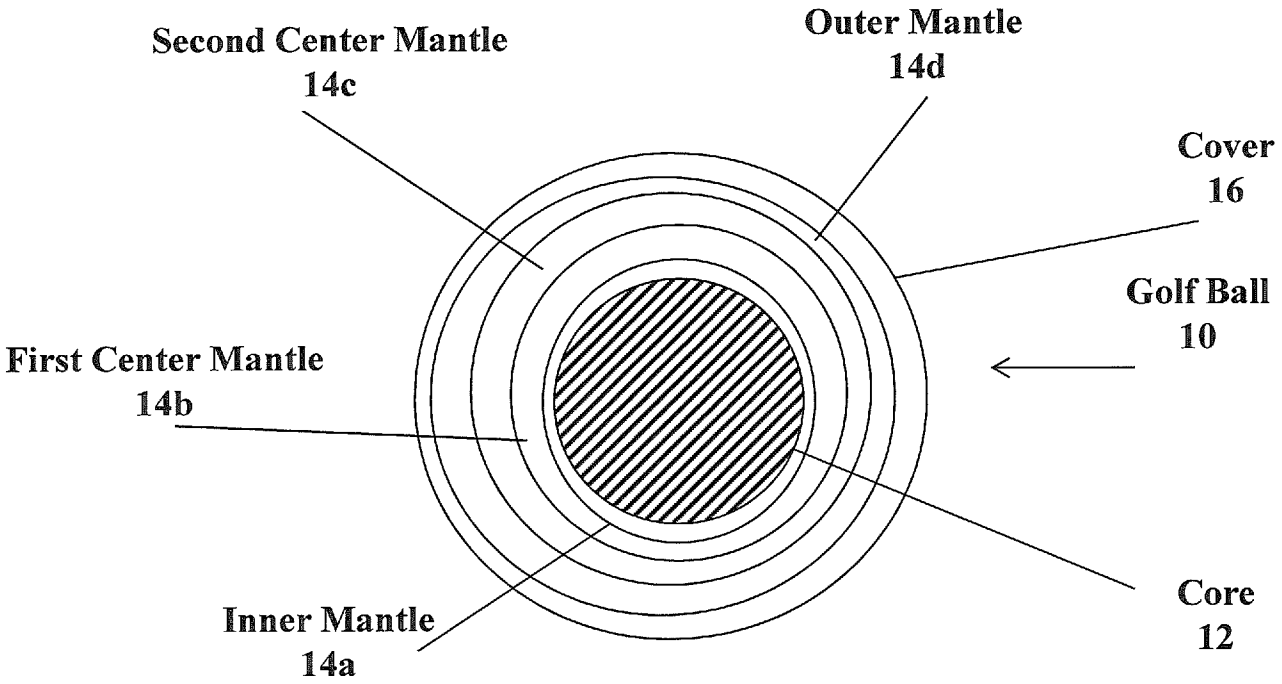
FIG. 4 is a cross-sectional view of a core layer, the mantle component and a cover layer of a golf ball.

A preferred embodiment of a golf ball 10 is shown in FIGS. 1-4. The golf ball 10 comprises a core 12, a mantle component 14 and a cover 16. The mantle component 14 comprises an inner mantle layer 14*a*, a first center mantle layer 14*b*, a second center mantle layer 14*c* and an outer mantle layer 14*d*. The golf ball 10 preferably has a diameter of at least 1.68 inches, a mass ranging from 45 grams to 47 grams, and a COR of at least 0.79.

The cover 16 is preferably composed of a thermoplastic polyurethane material, and preferably has a thickness ranging from 0.025 inch to 0.04 inch, and more preferably ranging from 0.03 inch to 0.04 inch. The material of the cover 16 preferably has a Shore D plaque hardness ranging from 30 to 60, and more preferably from 40 to 50. The Shore D hardness measured on the cover 16 is preferably less than 56 Shore D. Preferably the cover 16 has a Shore A hardness of less than 96. Alternatively, the cover 16 is composed of a thermoplastic polyurethane/polyurea material. One example is disclosed in U.S. Pat. No. 7,367,903 for a Golf Ball, which is hereby incorporated by reference in its entirety.

The mantle component 14 is composed of the inner mantle layer 14*a*, the first center mantle layer 14*b*, the second center mantle layer 14*c* and the outer mantle layer 14*d*. The mantle component 14 preferably has a thickness ranging from 0.160 inch to 0.2 inch, and more preferably from 0.170 inch to 0.190 inch.

The outer mantle layer 14*d* is preferably composed of a blend of ionomer materials. One preferred embodiment comprises SURLYN 9150 material, SURLYN 8940 material, a SURLYN AD1022 material, and a masterbatch. The SURLYN 9150 material is preferably present in an amount ranging from 20 to 45 weight percent of the layer, and more preferably 30 to 40 weight percent. The SURLYN 8945 is preferably present in an amount ranging from 15 to 35 weight percent of the layer, more preferably 20 to 30 weight percent, and most preferably 26 weight percent. The SURLYN 9945 is preferably present in an amount ranging from 30 to 50 weight percent of the layer, more preferably 35 to 45 weight percent, and most preferably 41 weight percent. The SURLYN 8940 is preferably present in an amount ranging from 5 to 15 weight percent of the layer, more preferably 7 to 12 weight percent, and most preferably 10 weight percent.

SURLYN 8320, from DuPont, is a very-low modulus ethylene/methacrylic acid copolymer with partial neutralization of the acid groups with sodium ions. SURLYN 8945, also from DuPont, is a high acid ethylene/methacrylic acid copolymer with partial neutralization of the acid groups with sodium ions. SURLYN 9945, also from DuPont, is a high acid ethylene/methacrylic acid copolymer with partial neutralization of the acid groups with zinc ions. SURLYN 8940, also from DuPont, is an ethylene/methacrylic acid copolymer with partial neutralization of the acid groups with sodium ions.

The inner mantle layer 14*a* is preferably composed of an ionomer, preferably SURLYN AD1035. The material for the inner mantle layer preferably has a Shore D plaque hardness ranging preferably from 30 to 45, more preferably from 30 to 40, a most preferably approximately 35. The thickness of the inner mantle layer 14*a* preferably ranges from 0.030 inch to 0.050 inch, and is more preferably approximately 0.045 inch.

The first center mantle layer 14*b* is preferably composed of a HPF material available from DuPont, having a Shore D hardness ranging from 30 to 50, and most preferably 44 Shore D. The thickness of the first center mantle layer 14*b* preferably ranges from 0.030 inch to 0.050 inch, and is more preferably approximately 0.045 inch.

The second center mantle layer 14*c* is preferably composed of a HPF material available from DuPont, having a Shore D hardness ranging from 40 to 55, and most preferably 51 Shore D. The thickness of the second center mantle layer 14*c* preferably ranges from 0.030 inch to 0.050 inch, and is more preferably approximately 0.045 inch.

Preferably the core 12 has a diameter ranging from 1.20 inch to 1.50 inches, more preferably from 1.25 inch to 1.35 inch, and most preferably approximately 1.28 inch. Preferably the core has a Shore D surface hardness ranging from 30 to 50, more preferably from 30 to 45, and most preferably approximately 40. Preferably the core is composed of a highly neutralized polymer material. Preferably the core 12 have a mass ranging from 25 grams to 35 grams, 30 grams to 34 grams and most preferably approximately 32 grams.

In a particularly preferred embodiment of the invention, the golf ball preferably has an aerodynamic pattern such as disclosed in Simonds et al., U.S. Pat. No. 7,419,443 for a Low Volume Cover For A Golf Ball, which is hereby incorporated by reference in its entirety. Alternatively, the golf ball has an aerodynamic pattern such as disclosed in Simonds et al., U.S. Pat. No. 7,338,392 for An Aerodynamic Surface Geometry For A Golf Ball, which is hereby incorporated by reference in its entirety. Alternatively, the golf ball has an aerodynamic pattern such as disclosed in Simonds et al., U.S. Pat. No. 7,468,007 for a Dual Dimple Surface Geometry For A Golf Ball, which is hereby incorporated by reference in its entirety.

Various aspects of the present invention golf balls have been described in terms of certain tests or measuring procedures. These are described in greater detail as follows.

As used herein, "Shore D hardness" of the golf ball layers are measured generally in accordance with ASTM D-2240 type D, except the measurements may be made on the curved surface of a component of the golf ball, rather than on a plaque. If measured on the ball, the measurement will indicate that the measurement was made on the ball. In referring to a hardness of a material of a layer of the golf ball, the measurement will be made on a plaque in accordance with ASTM D-2240. Furthermore, the Shore D hardness of the cover is measured while the cover remains over the mantles and cores. When a hardness measurement is made on the golf ball, the Shore D hardness is preferably measured at a land area of the cover.

As used herein, "Shore A hardness" of a cover is measured generally in accordance with ASTM D-2240 type A, except the measurements may be made on the curved surface of a component of the golf ball, rather than on a plaque. If measured on the ball, the measurement will indicate that the measurement was made on the ball. In referring to a hardness of a material of a layer of the golf ball, the measurement will be made on a plaque in accordance with ASTM D-2240. Furthermore, the Shore A hardness of the cover is measured while the cover remains over the mantles and cores. When a hardness measurement is made on the golf ball, Shore A hardness is preferably measured at a land area of the cover The resilience or coefficient of restitution (COR) of a golf ball is the constant "e," which is the ratio of the relative velocity of an elastic sphere after direct impact to that before impact. As a result, the COR ("e") can vary from 0 to 1, with 1 being equivalent to a perfectly or completely elastic collision and 0 being equivalent to a perfectly or completely inelastic collision.

COR, along with additional factors such as club head speed, club head mass, ball weight, ball size and density, spin rate, angle of trajectory and surface configuration as well as environmental conditions (e.g. temperature, moisture, atmospheric pressure, wind, etc.) generally determine the distance a ball will travel when hit. Along this line, the distance a golf ball will travel under controlled environmental conditions is a function of the speed and mass of the club and size, density and resilience (COR) of the ball and other factors. The initial velocity of the club, the mass of the club and the angle of the ball's departure are essentially provided by the golfer upon striking. Since club head speed, club head mass, the angle of trajectory and environmental conditions are not determinants controllable by golf ball producers and the ball size and weight are set by the U.S.G.A., these are not factors of concern among golf ball manufacturers. The factors or determinants of interest with respect to improved distance are generally the COR and the surface configuration of the ball.

The coefficient of restitution is the ratio of the outgoing velocity to the incoming velocity. In the examples of this application, the coefficient of restitution of a golf ball was measured by propelling a ball horizontally at a speed of 125+/−5 feet per second (fps) and corrected to 125 fps against a generally vertical, hard, flat steel plate and measuring the ball's incoming and outgoing velocity electronically. Speeds were measured with a pair of ballistic screens, which provide a timing pulse when an object passes through them. The screens were separated by 36 inches and are located 25.25 inches and 61.25 inches from the rebound wall. The ball speed was measured by timing the pulses from screen 1 to screen 2 on the way into the rebound wall (as the average speed of the ball over 36 inches), and then the exit speed was timed from screen 2 to screen 1 over the same distance. The rebound wall was tilted 2 degrees from a vertical plane to allow the ball to rebound slightly downward in order to miss the edge of the cannon that fired it. The rebound wall is solid steel.

As indicated above, the incoming speed should be 125±5 fps but corrected to 125 fps. The correlation between COR and forward or incoming speed has been studied and a correction has been made over the ±5 fps range so that the COR is reported as if the ball had an incoming speed of exactly 125.0 fps.

The measurements for deflection, compression, hardness, and the like are preferably performed on a finished golf ball as opposed to performing the measurement on each layer during manufacturing.

A discussion of the USGA initial velocity test is disclosed in Yagley et al., U.S. Pat. No. 6,595,872 for a Golf Ball With High Coefficient Of Restitution, which is hereby incorporated by reference in its entirety. Another example is Bartels et al., U.S. Pat. No. 6,648,775 for a Golf Ball With High Coefficient Of Restitution, which is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A golf ball comprising:

a core composed of a fully neutralized polymer material, having a diameter ranging from 1.20 inch to 1.50 inches, and mass ranging from 25 grams to 35 grams;

a mantle component disposed over the core, the mantle component comprising a plurality of mantle layers, wherein the mantle component has a thickness ranging from 0.160 inch to 0.2 inch, wherein each of the plurality of mantle layers has a thickness ranging from 0.030 inch to 0.050 inch, wherein at least one layer of the plurality of mantle layers is composed of a fully neutralized polymer material, and at least one layer of the plurality of mantle layers is composed of a blend of ionomer materials; and a cover layer disposed over the outer mantle layer, the cover having a thickness ranging from 0.025 inch to 0.040 inch, the cover composed of a thermoplastic polyurethane material;

wherein the mantle component has a density substantially equal to the density of the core;

wherein golf ball has a diameter of at least 1.68 inches, and a mass ranging from 45 grams to 47 grams.

2. The golf ball according to claim 1 wherein the golf ball has a COR of at least 0.79.

3. The golf ball according to claim 1 wherein the mantle component comprises an outer mantle layer comprising a blend of ionomer materials, a first center mantle layer comprising a fully neutralized polymer material, a second center mantle layer comprising a fully neutralized polymer material, and an inner mantle layer comprising an ionomer material.

4. A golf ball comprising:

a core composed of a fully neutralized polymer material, having a diameter ranging from 1.20 inch to 1.50 inches, and mass ranging from 25 grams to 35 grams;

a mantle component disposed over the core, the mantle component comprising a plurality of mantle layers, wherein the mantle component has a thickness ranging from 0.160 inch to 0.2 inch, wherein at least one layer of the plurality of mantle layers is composed of a fully neutralized polymer material, and at least one layer of the plurality of mantle layers is composed of a blend of ionomer materials; and a cover layer disposed over the outer mantle layer, the cover having a thickness ranging from 0.025 inch to 0.040 inch, the cover composed of a thermoplastic polyurethane material;

wherein the mantle component has a density substantially equal to the density of the core;

wherein golf ball has a diameter of at least 1.68 inches, and a mass ranging from 45 grams to 47 grams.

* * * * *